United States Patent [19]

Steers et al.

[11] Patent Number: 4,760,229

[45] Date of Patent: Jul. 26, 1988

[54] MICROWAVE OVEN WITH A DOOR-CLOSING SAFETY DEVICE

[75] Inventors: Michel Steers, La Queue en Brie; Jean-Pierre Hazan, Sucy-en-Brie; Gilles Delmas, Paris, all of France

[73] Assignee: U.S. Philips Corp., New York, N.Y.

[21] Appl. No.: 53,164

[22] Filed: May 21, 1987

[30] Foreign Application Priority Data

May 23, 1986 [FR] France ..... 86 07391

[51] Int. Cl.[4] ..... H05B 6/76

[52] U.S. Cl. ..... 219/10.55 D; 219/10.55 C; 219/10.55 B; 126/197; 324/96

[58] Field of Search ..... 219/10.55 B, 10.55 C, 219/10.55 R, 10.55 D; 126/197, 192; 340/600, 545; 324/96, 95, 97

[56] References Cited

U.S. PATENT DOCUMENTS

| | | | |
|---|---|---|---|
| 3,604,783 | 9/1971 | Roth | 219/10.55 D |
| 3,746,824 | 7/1973 | Prucha | 219/10.55 D |
| 3,955,060 | 5/1976 | Laszlo | 219/10.55 D |
| 4,065,655 | 12/1977 | Wong et al. | 219/10.55 D |
| 4,371,869 | 2/1983 | Davidson | 340/600 X |
| 4,565,967 | 1/1986 | Eisenbrandt et al. | 219/10.55 D |

FOREIGN PATENT DOCUMENTS 1236105 9/1967 Fed. Rep. of Germany .

*Primary Examiner*—Philip H. Leung
*Attorney, Agent, or Firm*—Ernestine C. Bartlett

[57] ABSTRACT

A microwave oven with a door-closing safety device is provided wherein a movable door comprises a device wherein the beam of at least one light emitter is guided by means of light guides towards a light beam detector. The light guides are arranged along a substantial portion of at least one side of the oven door frame. The beam of light in its non-guided path between the emitter and the detector passes through diaphragms, integral with the oven door, each diaphragm having an aperture such that the light beam passes through it when the door is properly closed but wherein the light beam is intercepted by the edge of the diaphragm when the door is not properly closed. The detector activates a signal that actuates the magnetron when the light beam is received; however, when the beam is intercepted, activation of the magnetron is prevented thereby preventing leakage of microwave energy.

18 Claims, 2 Drawing Sheets

MICROWAVE OVEN WITH A DOOR-CLOSING SAFETY DEVICE

FIELD OF THE INVENTION

The invention relates to a microwave oven comprising a magnetron emitting microwaves inside a cooking chamber which can be closed by a movable door, the oven being provided with a light emitter which emits a light beam towards a light detector through a diaphragm so as to constitute a safety device which, if the door is closed incorrectly or not at all, prevents the magnetron from operating in order to prevent the escape of any microwave energy.

BACKGROUND OF THE INVENTION

An oven of this type is known from the document DE No. 1,236,105, which describes a door-closing safety device for a microwave oven. For this purpose a metal strip is connected to the oven door. When the door is not closed correctly light from a light source mounted on the oven frame is incident on this strip. This strip has a small aperture through which the light can reach a photo-electric cell when the door is closed correctly, thus enabling the magnetron to be energized. However, this device is restricted to a particular location and provides only a limited protection. During use the closing properties of the door will gradually deteriorate and microwave energy will be able to escape although the door may appear to be properly closed when the device in accordance with said document is used.

Likewise, this safety device does not make provision for the situation in which, although the device is operating correctly, there are nevertheless microwave energy leaks owing to the warping of the door. This is a highly critical problem with microwave ovens, since the safety standards in force require leaks to be very small around the entire door opening. Moreover, it is desirable for these standards to be met throughout the useful life of the oven. During use, the door may tend to become distorted or shift position, the standards are no longer met and users may become unacceptably irradiated.

SUMMARY OF THE INVENTION

It is therefore the object of the invention to detect any deformation or shifting of the door or frame and prevent the operation of the magnetron.

In order to achieve this, the invention as defined in the preamble is characterized in that the beam of at least one light emitter is guided by means of light guides towards at least one light detector or receiver, the light guides being integral with the frame of the cooking chamber over the greater part of at least one side, the beam of light in its non-guided path between the emitter and the receiver passing through diaphragms integral with the movable door, each diaphragm having at its periphery an aperture such that the light beam passes through it correctly when the movable door is properly closed and such that the light beam is intercepted by the edges of the diaphragm when the movable door is incorrectly closed or deformed or has shifted its position, in order to prevent the magnetron from operating.

The light guides are arranged along 1, 2, 3 or 4 sides of the cooking chamber frame inside the oven casing. Each side, over the greater part may be fitted with one or more successive guides transparent to light and arranged in such a way that their optical axes are co-linear. These guides may, for example, be of plastic or glass. Each side may be independent of the others and have its own light emitter and detector. It is preferable to use a single light emitter and a single detector, ensuring the optical continuity of the device by fitting at the corners of the chamber frame a mirror which may be plane or preferably concave in order to focus the light beam. These mirrors may be of glass or metal, for example. There are thus one or more light beams aimed along the frame. These beams are used to check the parallelism and proper position of the door in relation to the frame by fitting the door with one or more diaphragms consisting of plates with holes drilled in them. These diaphragms are fitted in apertures arranged in the frame so that, in ideal conditions, each hole in each diaphragm allows the light beam through. If, however, abnormal circumstances result in the incorrect positioning of just one of the diaphragms, the light beam is intercepted and the light detector receives no luminous flux. The fact that there is then no signal is used to prevent the magnetron from operating. Owing to their small size, the diaphragms are obviously fully used even for small door movements. The size of the light beams determines the maximum clearance in the door movements. The safety device and the magnetron itself are neutralised by a door-operated switch when the door is opened during the normal use of the oven.

It is obviously possible to reverse the position of the constituent components of the invention and to make the diaphragms integral with the door frame, with the emitter, receiver and light guides integrally secured to the door.

BRIEF DESCRIPTION OF THE DRAWING

The invention will be better understood with reference to the following figures, given by way of non-limitative example, wherein.

DETAILED DESCRIPTION OF THE PREFERRED EMBODIMENTS

Figure 1:
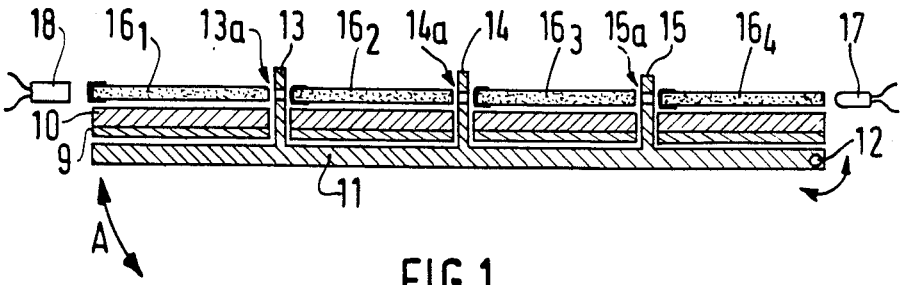
FIG. 1 is a diagrammatic cross-section of one of the sides of the oven, comprising the frame, the door fitted with diaphragms and the light guides.

FIG. 1 is a diagrammatic cross-section of one of the sides of the cooking chamber. The drawing is not to scale.

This figure shows a rigid frame 10 of the oven's cooking chamber, covered with a protective plate 9, and a door 11 capable of moving about an axis 12. This door 11 comprises diaphragms, e.g. 13, 14 and 15. Each diaphragm has a hole or aperture 13*a*, 14*a* and 15*a*. Light guides $\mathbf{16}_1$, $\mathbf{16}_2$, $\mathbf{16}_3$ and $\mathbf{16}_4$ are rigidly secured to frame 10 so that their optical axes are co-linear. A light emitter 17 emits a beam of light passing through light guides $\mathbf{16}_1$, $\mathbf{16}_2$, $\mathbf{16}_3$ and $\mathbf{16}_4$ and the diaphragm holes 13*a*, 14*a* and 15*a* to reach detector 18. The diameter of these holes may, for example, be 1 mm. The oven door can move in direction A by rotation about axis 12. If the door is incorrectly closed or if its planeness or position has been affected by distortion or if the frame should become distorted the light beam is intercepted by the edges of the diaphragm and can no longer pass through the holes. Detector 18 then detects no signal.

FIG. 1 shows one side of the cooking chamber frame. The same components may be fitted on all four sides, but the number of emitters and receivers may be reduced by fitting mirrors at the frame corners. This arrangement is shown on FIG. 2, which is a diagram of the front as its appears when protective plate 9 of FIG. 1 is removed. Frame 10 of the cooking chamber is surrounded on each side by light guides $16_1$ to $16_4$, $21_1$ to $21_4$, $22_1$ to $22_4$ and $23_1$ to $23_4$. The beam of light passing through the guides passes through each hole in each diaphragm secured to the movable door when the latter is properly closed. The beam is deflected at the frame corners by mirrors, e.g. mirrors 24, 26 and 28. They may be plane or preferably concave in order to focus the beam. The light beam from emitter 17*b* passes through the guides and diaphragms and is deflected by the mirrors to reach detector 18. The device can thus detect distortion or shifts in the position of the movable door or the frame itself.

Figure 2:
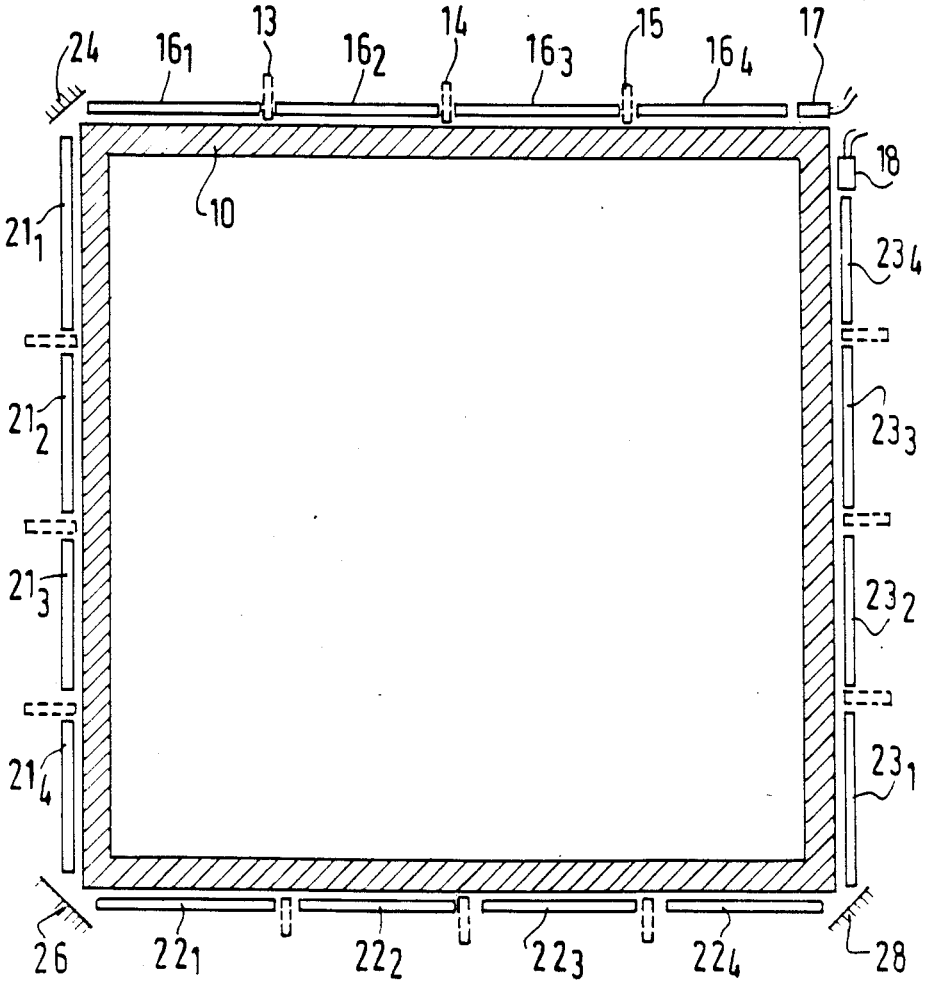
FIG. 2 is a diagrammatic front view of the frame of the cooking chamber.

FIG. 2 shows a structure with four light guides and three diaphragms per side. It is obviously possible to fit a much smaller number of components depending on the degree of protection which it is desired to obtain.

Figure 3:
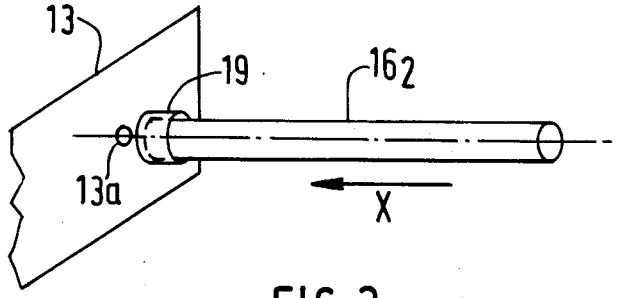
FIG. 3 is a diagrammatic view of details of a light guide fitted with its own diaphragm.

FIG. 3 is a diagram of the detail of a light guide arranged in front of the hole in a diaphragm. With the door properly closed, the axis of light guide $16_2$ passes through the centre of hole 13*a* of diaphragm 13. In order to ensure that the maximum permissible clearance on the door closure is of the order of a mm so that any microwave energy leaks remain below the permissible limits, the diameter of the light beam must be very small. It may, for example, be 1 mm. Depending on the cross-section of light guide $16_2$, it may be necessary to reduce the cross-section of the beam at the guide output by fitting another diaphragm 19 at the output of each guide. By altering the cross-section of the holes in diaphragms 13 and 19, it is thus possible to adjust the precision to be obtained and thus the permissible clearance on the door.

Figure 4:
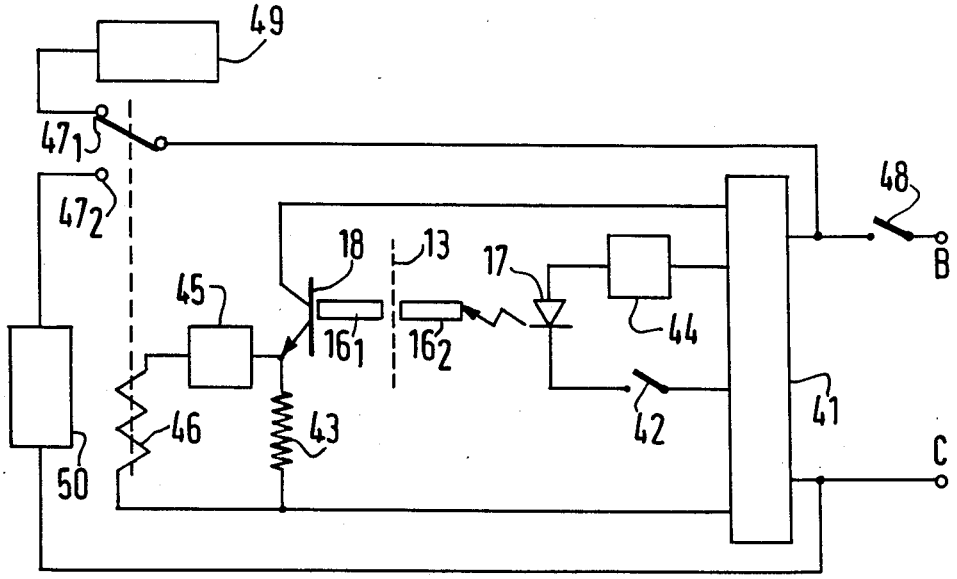
FIG. 4 is an electrical circuit diagram of a safety device of the invention.

FIG. 4 is an electrical circuit diagram of a safety device of the invention. Only two guides, $16_1$ and $16_2$ are shown. Emitter 17 is an electro-luminescent diode and receiver or detector 18 is a photo-transistor. The beam may be intercepted by diaphragm 13.

Low-voltage power supply unit 41 of the device of the invention powers emitter 17 via door-operated switch 42, which breaks when the door is open and makes when the door is closed, thus allowing the emitter to emit luminous flux and rendering the safety device operational. In order to eliminate problems arising from parasitic ambient light, emitter 17 is preferably modulated by a modulation circuit 44, of the 30 kHz type, for example, in accordance with the usual practice. Unit 41 also powers photo-transistor 18, which has a resistor 43 in its emitter circuit.

The modulated signal detected by receiver 18 is demodulated by demodulation circuit 45 which supplies a signal which excites coil 46 of a relay. Contacts $47_1$ and $47_2$ of this relay are respectively connected to an alarm 49 and the magnetron power supply circuit 50. If the detector receives no luminous flux or a flux below a predetermined threshold, the alarm is activated to warn the user. The alarm may be audible or visible. When the detector receives luminous flux, the magnetron power supply circuit is actuated, allowing the microwave oven to operate. The oven's electric circuits are controlled by a master switch 48 for their power supply and by the electrical system between points B and C.

What is claimed is:

1. A microwave oven which comprises:

a cooking chamber having a peripheral frame;

a magnetron emitting microwaves inside said cooking chamber when actuated;

at least one light beam emitter;

at least one light beam detector which when a light beam is detected supplies a signal effective to actuate said magnetron;

a movable door to open and close said cooking chamber;

light guides positioned over a substantial portion of at least one side of said frame to form a guided path for said light beam from said emitter to said detector;

at least one diaphragm intimately associated with said door, each said diaphragm having peripheral edges and an aperture adjoining said light guide to form a non-guided path for said light beam from said emitter to said detector;

said emitter emitting a light beam which travels through said light beam guides toward said detector, the light beam in said non-guided path passing through said diaphragm aperture when said door is properly closed but being intercepted by the edges of said diaphragm when said door is not properly closed, said light interception being effective to prevent activation of the magnetron thereby preventing operation of the microwave oven.

2. A microwave oven as claimed in claim 1, wherein there is a said light emitter associated with a said light detector for each side of the oven door frame.

3. A microwave oven as claimed in claim 1, wherein the path of said light beam between the light emitter and said detector is deflected at corners of the oven by mirrors attached to the oven frame.

4. A microwave oven as claimed in claim 3, wherein the mirror is concave to focus the beam.

5. A microwave oven as claimed in claim 1, wherein the diameter of the aperture in each diaphragm is substantially 1 mm.

6. A microwave oven as claimed in claim 1, wherein the light emitter is an electroluminescent diode.

7. A microwave oven as claimed in claim 1, wherein the light detector is a phototransistor.

8. A microwave oven as claimed in claim 1, wherein the output of at least one said light guide comprises an additional diaphragm with an aperture limiting the size of the beam.

9. A microwave oven as claimed in claim 1, wherein the oven further comprises an audible or visible alarm and the light detector actuates said audible or visible alarm when defective operation is detected.

10. A microwave oven which comprises:

a cooking chamber having a four-sided peripheral frame;

a magnetron which when actuated, emits microwaves inside the cooking chamber;

at least one light emitter, capable of emitting luminous flux;

at least one light beam detector which, when it receives luminous flux above a predetermined threshold acts to actuate said magnetron;

a movable oven door;

at least one light guide arranged along each side of said oven frame;

at least one diaphragm formed integral with said oven door, each said diaphragm having peripheral edges and an aperture adjoining said light guide to form a non-guided path for said light beam from said emitter to said detector;

whereby a safety device is provided which, if said door is properly aligned with said frame, permits the light beam to pass through said diaphragm aperture to said detector but which, if said door is not properly aligned with said frame, intercepts the light beam and prevents actuation of said magnetron.

11. A microwave oven as claimed in claim 10, wherein there is a said light emitter associated with a said light detector for each side of the oven door frame.

12. A microwave oven as claimed in claim 10, wherein the path of the said light beam between the said light emitter and detector is deflected at corners of the oven by mirrors attached to the oven frame.

13. A microwave oven as claimed in claim 10, wherein the mirror is concave to focus the beam.

14. A microwave oven as claimed in claim 10, characterized the diameter of the hole aperture in each diaphragm is substantially 1 mm.

15. A microwave oven as claimed in claim 10, wherein the light emitter is an electroluminescent diode.

16. A microwave oven as claimed in claim 10, wherein the light detector is a phototransistor.

17. A microwave oven as claimed in claim 10, wherein the output of at least one said light guide comprises an additional diaphragm with an aperture limiting the size of the beam.

18. A microwave oven as claimed in claim 10, wherein the oven further comprises an audible or visible alarm and the light detector actuates said audible or visible alarm when defective operation is detected.

* * * * *

UNITED STATES PATENT AND TRADEMARK OFFICE

CERTIFICATE OF CORRECTION

PATENT NO. : 4,760,229

DATED : July 14, 1988

INVENTOR(S) : Michel Steers Et Al

It is certified that error appears in the above-identified patent and that said Letters Patent is hereby corrected as shown below:

Claim 14, Change "characterized" to --wherein--.

Signed and Sealed this

Seventeenth Day of January, 1989

*Attest:*

DONALD J. QUIGG

*Attesting Officer*

*Commissioner of Patents and Trademarks*